US007021557B2

(12) United States Patent
Shafer et al.

(10) Patent No.: US 7,021,557 B2
(45) **Date of Patent: *Apr. 4, 2006**

(54) THIN FILM COATINGS FOR FUEL INJECTOR COMPONENTS

(75) Inventors: Scott F. Shafer, Morton, IL (US); Jay E. Tomaseski, Gainesville, GA (US); Chuong Q. Dam, San Jose, CA (US); Michael C. Long, Germantown Hills, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/778,053

(22) Filed: Feb. 17, 2004

(65) Prior Publication Data

US 2004/0195386 A1 Oct. 7, 2004

Related U.S. Application Data

(63) Continuation of application No. 09/959,026, filed as application No. PCT/US00/40001 on Feb. 15, 2000, now Pat. No. 6,715,693.

(51) Int. Cl.
*F02M 47/02* (2006.01)
*F02M 59/00* (2006.01)
*B05B 1/30* (2006.01)

(52) U.S. Cl. ..... 239/88; 239/533.2; 239/533.12; 239/533.14; 239/585.1; 239/585.3; 239/585.4; 239/585.5

(58) Field of Classification Search ..... 239/88, 239/533.2, 533.3, 533.11, 533.12, 583, 584, 239/585.1–585.5, 591, 533.14; 251/129.15, 251/129.21, 127

See application file for complete search history.

(56) References Cited

U.S. PATENT DOCUMENTS

| | | | |
|---|---|---|---|
| 3,738,779 | A | 6/1973 | Hein et al. |
| 3,797,245 | A | 3/1974 | Hein |
| 3,945,764 | A | 3/1976 | Marietta |
| 4,028,010 | A | 6/1977 | Hopkins |
| 4,097,196 | A | 6/1978 | Habiger |
| 4,212,596 | A | 7/1980 | Ruseff |

(Continued)

FOREIGN PATENT DOCUMENTS

| | | |
|---|---|---|
| DE | 4137224 | 5/1993 |

(Continued)

OTHER PUBLICATIONS

Copending U.S. Appl. No. 10/864,404, filed on Jun. 10, 2004.

*Primary Examiner*—Davis Hwu
(74) *Attorney, Agent, or Firm*—Finnegan, Henderson, Farabow, Garrett & Dunner LLP

(57) ABSTRACT

A thin film coating for a low allow steel or tool steel components in a fuel injector (14), such as a fuel injector needle valve (86) is disclosed. A thin film coating (96) consists of a metal carbon material layer less than 2.0 microns thick applied to a low alloy steel substrate (95) or tool steel substrate (95) used in fuel injector components, such as the fuel injector needle valve (86) or a portion thereof. Optionally, a thin bond layer (98) of chromium is deposited between the steel substrate (95) and the primary metal carbon material coating (96). The thin film coating (96) minimizes abrasive and adhesive wear associated with the needle valve (86) and cooperating nozzle surfaces (62, 63) of the fuel injector (14).

29 Claims, 2 Drawing Sheets

U.S. PATENT DOCUMENTS

| | | | | | |
|---|---|---|---|---|---|
| 4,370,854 | A | | 2/1983 | Williams | |
| 4,402,994 | A | | 9/1983 | Kobayashi et al. | |
| 4,426,162 | A | | 1/1984 | Tsuchiya et al. | |
| 4,553,904 | A | | 11/1985 | Ruseff et al. | |
| 4,643,740 | A | | 2/1987 | Nicolson | |
| 4,856,713 | A | * | 8/1989 | Burnett | 239/113 |
| 4,951,878 | A | | 8/1990 | Casey et al. | |
| 5,222,870 | A | | 6/1993 | Budzich | |
| 5,226,975 | A | | 7/1993 | Denton et al. | |
| 5,237,967 | A | * | 8/1993 | Willermet et al. | 123/90.51 |
| 5,249,554 | A | * | 10/1993 | Tamor et al. | 123/90.51 |
| 5,309,874 | A | * | 5/1994 | Willermet et al. | 123/90.51 |
| 5,409,165 | A | | 4/1995 | Carroll, III et al. | |
| RE34,956 | E | | 5/1995 | Djordjevic | |
| 5,492,573 | A | | 2/1996 | Fukushima et al. | |
| 5,641,121 | A | | 6/1997 | Beck et al. | |
| 5,672,386 | A | | 9/1997 | Ooya | |
| 5,673,618 | A | | 10/1997 | Little | |
| 5,697,764 | A | | 12/1997 | Oda et al. | |
| 5,713,333 | A | | 2/1998 | Cooper et al. | |
| 5,771,873 | A | * | 6/1998 | Potter et al. | 123/668 |
| 5,773,734 | A | | 6/1998 | Young | |
| 5,783,261 | A | | 7/1998 | Potter et al. | |
| 5,843,571 | A | | 12/1998 | Sho | |
| 5,851,680 | A | | 12/1998 | Heau | |
| 6,083,570 | A | | 7/2000 | Lemelson et al. | |
| 6,145,763 | A | | 11/2000 | Fleming et al. | |
| 6,254,103 | B1 | | 7/2001 | Cooke | |
| 2002/0022129 | A1 | | 2/2002 | Moronuki | |

FOREIGN PATENT DOCUMENTS

| | | |
|---|---|---|
| DE | 3624134 | 1/1998 |
| DE | 19738351 | 3/1998 |
| DE | 19757702 | 7/1998 |
| EP | 0818622 | 1/1998 |
| GB | 1275456 | 5/1972 |
| JP | 7063135 | 3/1995 |
| WO | WO 97/48836 | 12/1997 |

* cited by examiner

THIN FILM COATINGS FOR FUEL INJECTOR COMPONENTS

This application is a continuation of U.S. application Ser. No. 09/959,026, filed Nov. 1, 2001, now U.S. Pat. No. 6,715,693, which was the National Stage of International Application No. PCT/US 00/40001 filed Feb. 15, 2000, both of which are incorporated herein by reference.

FIELD OF THE INVENTION

The present invention relates to thin film coatings for steel components used in fuel injectors, and more particularly for metal carbon material thin film coatings for low alloy steel or tool grade steel fuel injector needles.

BACKGROUND OF THE INVENTION

Many internal combustion engines, whether compression ignition or spark ignition engines, are provided with fuel injection systems to satisfy the need for precise and reliable fuel delivery into the combustion chamber of the engine. Such precision and reliability is necessary to address the goals of increasing fuel efficiency, maximizing power output, and controlling emissions or other undesirable by-products of combustion.

In direct injection diesel engine applications, a fuel injector is a precision device that must meter the quantity of fuel required for each cycle of the engine and must develop the high pressure necessary to inject the fuel into the combustion chamber at the correct instant of the engine operating cycle. Many fuel systems presently used in direct injection diesel engines utilize a hydraulically actuated and/or electronically controlled fuel injector to pressurize the fuel charge to obtain the desired fuel spray pattern and fuel volume into the combustion chamber at the precise moment.

Additionally, the many modern hydraulically actuated and/or electronically controlled fuel injectors often operate in a much more harsh or severe environment, in terms of operating temperatures, pressures, speeds, etc. than conventional fuel injectors. These hydraulically actuated and/or electronically controlled fuel injectors often use very compact and high precision moveable components such as the fuel injector needles; valves, and plungers to achieve the prescribed delivery of fuel at the desire time and for the desired duration.

As a result of the compact nature of many fuel injector components together with the harsher environment, the stresses and forces present within an operating fuel injector are often concentrated on such smaller components. The decreased surface area of the smaller components in which to spread out the higher contact forces and stresses causes fuel injectors and fuel injector components to experience increased adhesive and abrasive wear at the contact surfaces, such as the nozzle tip and check interface. In addition, fuel injectors and fuel injector components require superior hardness characteristics and lubricity characteristics to combat the higher contact stress.

The operability and reliability of a fuel injector is dependent, to some extent, on the fuel to be injected, and in particular on the lubricity, viscosity or other salient physical characteristics of the fuel to be injected. The use of low lubricity fuels, in particular, can cause several problems, and most notably fuel injector component wear (both abrasion and adhesion wear), which leads ultimately to the fuel injector tip failure or overall performance degradation of the fuel injector. Such form of wear is typically caused by lack of lubrication at the interface between two hard surfaces, causing a welding or adhesion of the contacting parts, e.g. the exterior surface of the fuel injector needle and interior surface of the fuel injector sliding and impacting against one another without proper lubrication tend to show evidence of severe wear. These forms or patterns of wear will change the clearance between the exterior surface of the fuel injection needle and the cooperating interior surface of the injector body or guide surface and will make the surfaces rough so the sliding motion of the components will not be smooth, both of which will lead to an incorrect amount of fuel injected into the system. Eventually, continued wear can lead to failure of the fuel injector tip and/or needle valve. As indicated above, wear patterns of fuel injector components is particularly evident in fuel injection systems that utilize low lubricity fuels.

Various related art techniques have considered the use of titanium nitride (TiN) coatings on fuel injector plungers and other components to reduce wear of the coated parts. A problem encountered with TiN coatings is that a TiN coating is usually applied at extremely high temperatures (e.g. about 450 degrees C.) which may produce unwanted thermal stresses and related failures to the fuel injector components. It is also believed that TiN coatings on fuel injector needle tend to increase the wear of the needle mating component at the mating or seating location. In addition, TiN coatings tend to increase the overall cost of the fuel injector needle because the TiN coated fuel injector needle requires tool grade steel to withstand the high temperatures observed in the application of the TiN coating.

Alternatively, several related art techniques have considered the use of ceramic materials as the base material for the fuel injector needle instead of low alloy steels. Unfortunately, the use of a ceramic material for fuel injector needles is very costly and the resulting monolithic ceramic fuel injector needles have not typically demonstrated the necessary durability or reliability for commercial use in diesel engines or other heavy duty engine applications.

The present invention aids in overcoming one or more of the aforementioned problems associated with the fuel injector needle members and satisfactorily addresses the shortcomings of the related art solutions to such problems.

DISCLOSURE OF THE INVENTION

The invention may be characterized as a metal carbon material or diamond like carbon coated low alloy steel or tool grade steel component for a fuel injector, such as a fuel injector needle, having suitable hardness characteristics, improved boundary lubrication characteristics, and improved wear resistance characteristics. The fuel injector component, such as a fuel injector needle or other contacting surface, comprises a low alloy steel or tool grade steel substrate and a primary thin film coating (e.g. titanium containing diamond like carbon, chromium containing diamond like carbon, or tungsten containing diamond like carbon) deposited on the low alloy steel or tool grade steel substrate. The primary coating preferably has a thickness generally no greater than about 2.0 microns. The preferred coating may also include a thin bond layer (e.g. less than 1.0 micron thick chromium layer) deposited between said low alloy steel or tool grade steel substrate and the primary metal carbon material coating.

A further aspect of the present invention is the resulting hardness, boundary lubricity, and wear resistance characteristics of the coated steel substrate. For example, the hardness of the metal carbon material coating is preferably greater than 1000 Kg/mm$^2$ as measured using a Hardness Knoop HDNS 50 gram load whereas the boundary lubricity and wear resistance characteristics of the coated substrate are generally improved over those of an non-coated steel substrate.

BEST MODE FOR CARRYING OUT THE INVENTION

The following description is of the best mode presently contemplated for carrying out the invention. This description is not to be taken in a limiting sense, but is made merely for the purpose of describing the general principals of the invention. The scope and breadth of the invention should be determined with reference to the claims.

Figure 1:
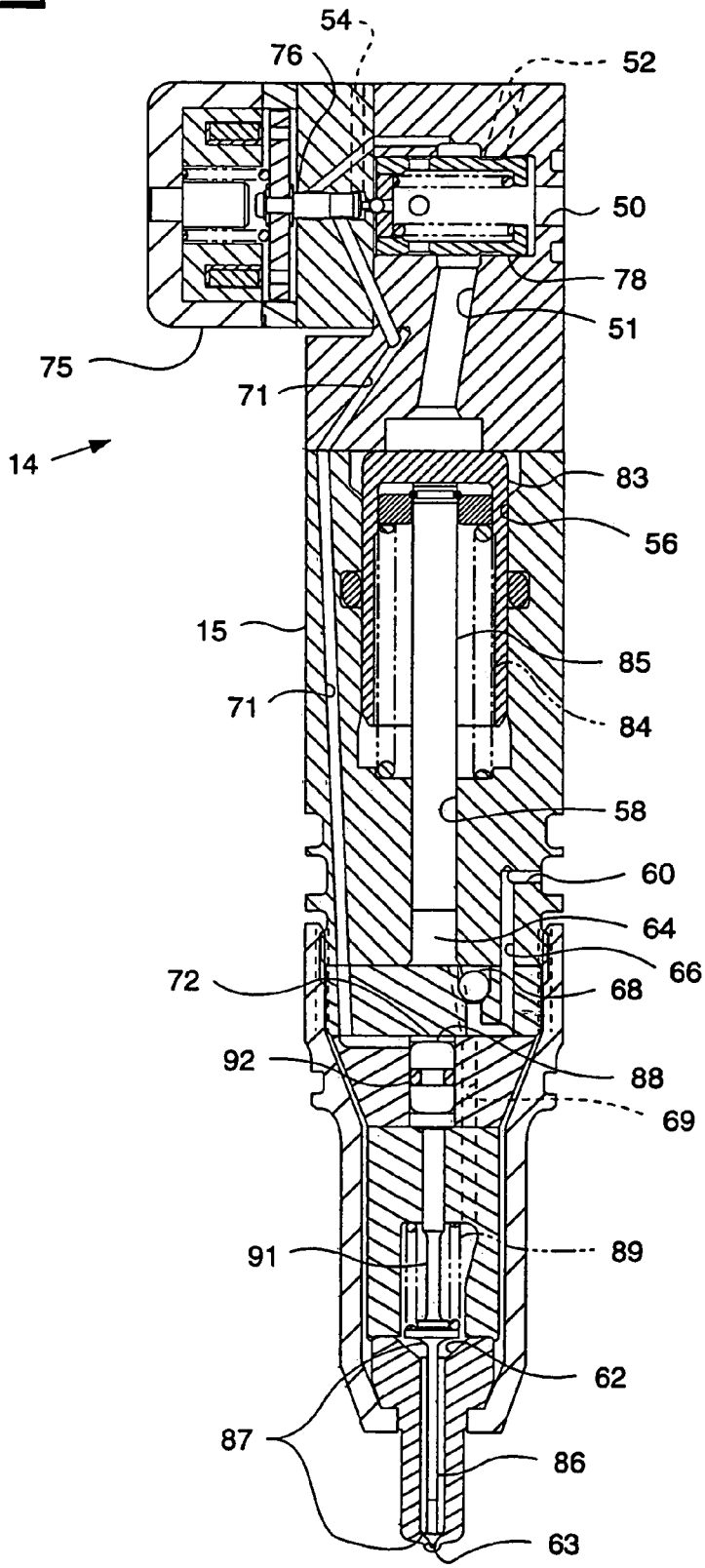
FIG. 1 is a cross-sectional view of a fuel injector.

Referring now to FIG. 1, a hydraulically actuated, electronically controlled fuel injector 14 having a needle check valve coated in accordance with the present invention is shown. Injector 14 includes an injector body 15 having an actuation fluid inlet 50 that is connected to a branch rail passage, actuation fluid drains 52 and 54 that are connected to actuation fluid recirculation line 71 and a fuel inlet 60 connected to a fuel supply passage 66. Injector 14 includes a hydraulic means for pressurizing fuel within the injector during each injection event and a needle valve member 86 that controls the opening and closing of nozzle outlet 63.

The hydraulic means for pressurizing fuel includes an actuation fluid control valve that alternately opens actuation fluid cavity 51 to the high pressure of actuation fluid inlet 50 or the low pressure of actuation fluid drain 52. The actuation fluid control valve includes a three-way solenoid 75 attached to a pin spool valve member 76. An intensifier spool valve member 78 responds to movement of pin spool valve member 76 to alternately open actuation fluid cavity 51 to actuation fluid inlet 50 or low pressure drain 52. The hydraulic pressurizing means also includes actuation fluid cavity 51 that opens to a piston bore 56, within which an intensifier piston 83 reciprocates between a return position (as shown) and a forward position. Injector body 15 also includes a plunger bore 58, within which a plunger 85 reciprocates between a retracted position (as shown) and an advanced position. A portion of plunger bore 58 and plunger 85 defines a fuel pressurization chamber 64, within which fuel is pressurized during each injection event. Plunger 85 and intensifier piston 83 are returned to their retracted positions between injection events under the action of compression spring 84. Thus, the hydraulic means for pressurizing fuel includes the fuel pressurization chamber 64, plunger 85, intensifier piston 83, actuation fluid inlet 50, actuation fluid cavity 51 and the various components of the actuation fluid control valve, which includes solenoid 75, pin spool valve member 76, ball check and intensifier spool valve member 78.

In the illustrated fuel injector, fuel enters injector 14 at fuel inlet 60 and travels along fuel supply passage 66, past ball check valve 68 and into fuel pressurization chamber 64, when plunger 85 is retracting. Ball check 68 prevents the reverse flow of fuel from fuel pressurization chamber 64 into fuel supply passage 66 during the plunger's downward stroke. Pressurized fuel travels from fuel pressurization chamber 64 via a connection passage 69 to nozzle chamber 62. A needle valve member 86 moves within nozzle chamber 62 between anzopen position in which nozzle outlet 63 is opened and a closed position in which nozzle outlet 63 is closed. Needle valve member 86 is mechanically biased to its closed position by a compression spring 89.

Needle valve member 86 includes opening hydraulic surfaces 87 exposed to fluid pressure within nozzle chamber 62 and a closing hydraulic surface 88 exposed to fluid pressure within a needle control chamber 72. Needle valve member 86 includes a needle portion 91 and intensifier portion 92 that are shown as separate pieces for ease of manufacturing, but both portions could be and are preferably machined as a single integral steel component.

It should be appreciated that pressurized fuel acts upon the opening hydraulic surfaces 87 whereas actuation fluid acts upon the closing hydraulic surface 88. Preferably, the closing hydraulic surface and the opening hydraulic surface are sized and arranged such that the needle valve member 86 is hydraulically biased toward its closed position when the needle control chamber is open to a source of high pressure fluid. Thus, in order to maintain direct control of needle valve member 86 despite high fuel pressure within nozzle chamber 62, there should be adequate pressure on the closing hydraulic surface 88 to maintain nozzle outlet 63 closed. When needle control chamber 72 is opened to a low pressure passage, needle valve member 86 performs, as a simple check valve of a type known in the art, in that it opens when fuel pressure acting upon opening, hydraulic surfaces 87 is greater than a valve opening pressure sufficient to overcome return spring 89. Thus, opening hydraulic surfaces 87 and closing hydraulic surface 88 are preferably sized and arranged such that the needle valve member is hydraulically biased toward its open position when the needle control chamber is connected to a low pressure passage and the fuel pressure within the nozzle chamber is greater than the valve opening pressure.

The multitude of forces, both hydraulic and mechanical, coupled with the frequency and speed at which the needle valve member opens and closes, result in the need for improved friction, boundary lubricity, and general wear characteristics.

Figure 2:
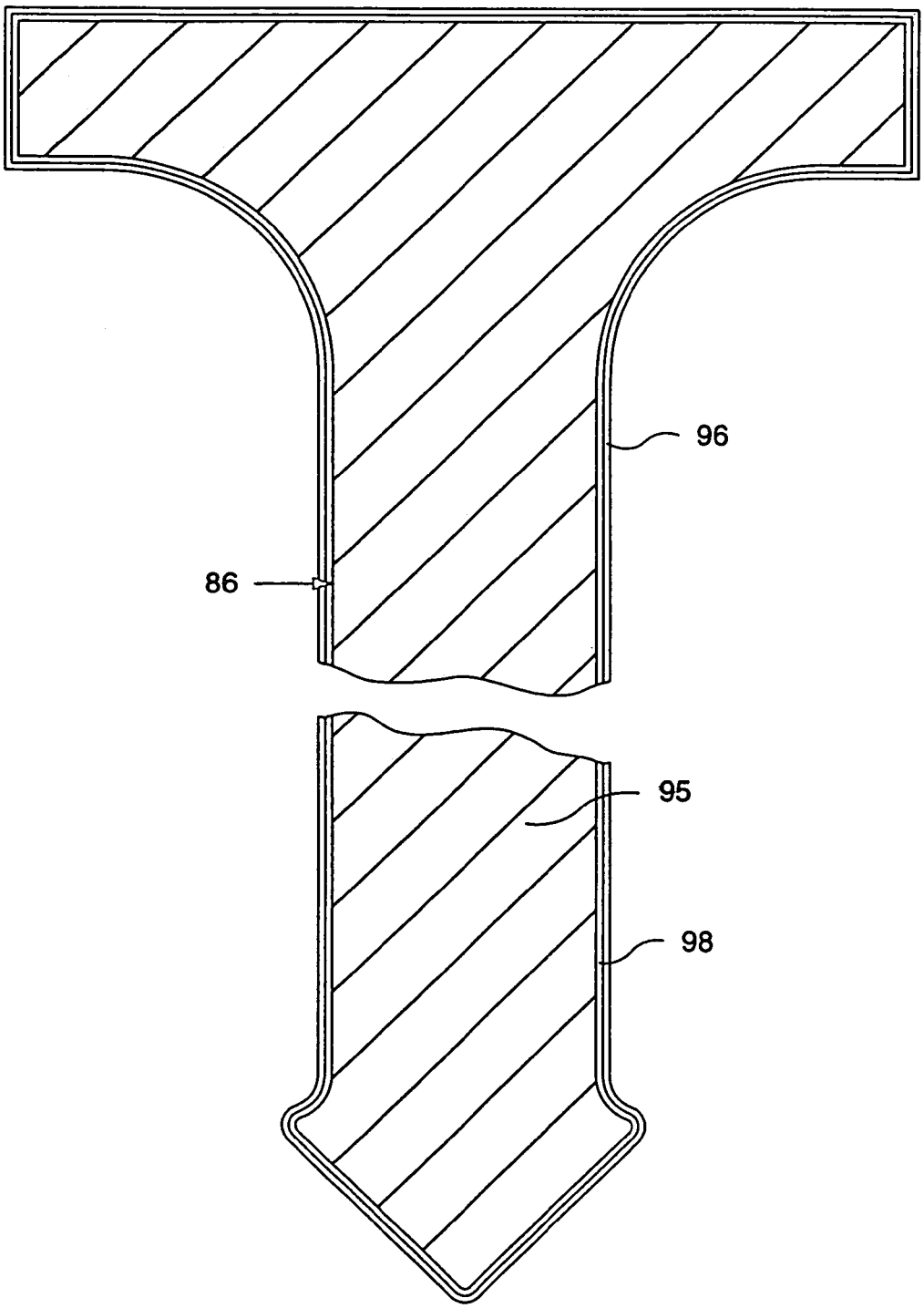
FIG. 2 is a side view of a coated fuel injection needle member in accordance with the present invention.

Turning now to FIG. 2, there is shown a side view of a coated fuel injector needle in accordance with the present invention. As seen in FIG. 2, the illustrated fuel injector needle valve includes a main body section, a lower section, and a loading end section. The various sections of the fuel injector needle 86 are formed or machined from a low alloy steel substrate or, more preferably, a tool steel substrate 95. The term "low alloy" as used herein means a steel grade in which the hardenability elements, such as manganese, chromium, molybdenum and nickel, collectively constitute less than about 3.5% by weight of the total steel composition. From an economic and reliability standpoint, a low alloy steel or tool steel substrate 95 is preferable for many fuel injector components, including the fuel injector needle and fuel injector nozzle.

Composition of the primary coating 96 is preferably selected from the group consisting of metal carbon materials such as titanium containing diamond like carbon (DLC), tungsten-DLC, or chromium-DLC. The preferable metal carbon material is a tungsten-DLC such as tungsten-carbide containing carbon. Where tungsten-carbide containing carbon is used the tungsten content is graded, and thus may range at any given layer of between about 0% to about 100%, more preferably between about 15% and about 30%.

Depending on the intended application and environment of the coated fuel injector component, it may be advantageous to apply a bond layer 98 of a chromium layer or other suitable metal layer to the steel substrate 95 to provide improved adhesion of the primary metal carbon material coating 96, if tungsten-carbide containing carbon is utilized as the primary coating. If used, the optional bond layer material is preferably applied using a similar vapor deposition process to yield a bond layer 98 having a thickness of generally between about 0.05 micron and 0.5 micron.

The coating thickness on the fuel injection needle valve member 86 should be fairly uniform as measured on a sample of the fuel injector needles by the Ball Crater Test at a plurality of locations on the needle. Alternatively one can demonstrate uniform coating thickness through scanning electron microscopy measurements on a sample of selected cross sections of the fuel injector needles, or through the use of X-ray fluorescence.

In the preferred embodiment, the primary metal carbon material coating has a thickness desirably no greater than about 2.0 microns and preferably has a thickness of between about 0.5 microns and about 1.7 microns. A primary coating thickness greater than about 2.0 microns is undesirable because the metal carbon thin film coating 96 may develop residual stresses high enough to separate the metal carbon thin film coating 96 from bond layer 98 or steel substrate 95. The thin film coating. 96 may be applied to the entire length of the needle valve member substrate 95 or the coating 96 may be applied partially, to the lower end of the needle valve member. In order to apply only a partial thin film coating, the needle valve member may be held by a small cup or retainer with a slightly larger diameter to hold the needle valve member in place during the coating process. The portion of the needle valve member to be coated is then exposed while the portion that is to be free from said coating would be disposed in and covered by the cup or retainer. Preferably, only the lower portion of the needle valve member proximate the fuel injector tip requires the thin film coating. However, it may be advantageous to apply a thin film coating to the entire substrate of the check valve for certain applications.

The chromium bond layer 98 has a thickness desirably no greater than about 1.0 micron and preferably has a thickness of between about 0.05 micron and 0.5 micron and most preferably between about 0.1 and 0.3. As with the primary coating 96, a bond layer thickness greater than the aformentioned thickness is undesirable because the bond layer 98 may develop residual stresses high enough to separate from the steel substrate 95 or needle valve member.

Control of some or all of the physical properties of the thin film coatings and coated substrate other than thickness are also important to producing a highly reliable needle member. For example, coating adhesion, coating hardness, substrate hardness, surface texture, frictional coefficients, are some of the physical properties that should be monitored. Although different applications may demand different physical properties, the following discussion discloses some of the properties in the preferred embodiments of the thin film coated fuel injector needle valve.

Broadly speaking, the applied thin film coatings should be generally free of surface defects and have a specified surface texture ratings or surface texture measurements dependent on the environment, specifications, and intended use of the component. Surface defects are generally observed on a sample of the fuel injector needle members coated through the observation of multiple points on the surface of the coated samples at about 100 times magnification factor. The surface observations are generally compared to various classification standards to ensure the coatings are substantially free from surface defects as opposed to pin holes and substrate defects.

In addition, the applied coatings should generally adhere to the steel substrate. Coating adhesion can be assessed for a given population of fuel injector needle members, for example, by using standard hardness tests (e.g. Rockwell C HDNS measurements). The impact locations on the surface are observed and generally compared to various adhesion classification standards based on the size and amount of cracks present and the flaking of the coatings.

In the disclosed embodiment, the coating hardness is also important characteristic of the fuel injector needle member. Preferably, the applied tungsten-carbide containing carbon coating maintains a hardness of greater than 1000 $Kg/mm^2$ as measured using a Hardness Knoop HDNS 50 gram load. In the disclosed embodiment, the substrate hardness after the coating process is preferably 75–79 RKW using a 30N hardness tester.

In the preferred embodiment, the coated steel substrate desirably has a boundary lubricity value greater than the boundary lubricity value of the steel substrate as measured using the ISO 12156, version 1.3 HFRR (High Frequency Reciprocating Rig). Also, the coated steel substrate desirably has a friction coefficient less than about 0.5, and more preferably a friction coefficient no more than about 0.2 whereas the friction coefficient of the non-oxidized, non-coated steel component is typically 0.5 or greater. It is also desirable that the friction coefficient be about 0.2 because the beneficial effects of enhanced boundary lubrication will be offset by a substantial increase in the friction coefficient.

Although not shown, it is readily understood by those skilled in the art that in addition to coating fuel injector needles, it would be equally advantageous to provide a coating to the component or surface with which the fuel injector needle contacts, namely the fuel injector nozzle surface. Coating of the contacting surfaces of the fuel injector nozzle and other fuel injector components with diamond like carbon coatings is advantageous not only from the added lubrication and friction characteristics of the coated component and cooperating surfaces, but also from the viewpoint of controlling the wear patterns of contacting surfaces, as explained herein.

Any one of the vapor deposition techniques, such as physical vapor deposition (e.g. sputtering), chemical vapor deposition and arc vapor deposition or hybrids thereof, can be employed to deposit the coatings on the low alloy steel or tool grade steel substrate. In the preferred embodiment with tungsten-carbide containing carbon selected as the primary coating, the preferred method used to apply the tungsten-carbide containing carbon coating should allows precise control over the amount of tungsten carbide in the thin film coating. As previously stated, the bond layer of chromium, utilized in conjunction with the tungsten-carbide containing carbon coating can be applied by sputtering or, more preferably, an arc vapor deposition (AVD) process.

In general, in arc vapor deposition, the arc source is adapted to impart a positive charge on the vapor generated. A negative bias voltage of a selected voltage (e.g. 50 Volts) is applied to the substrate by a voltage source. A vapor deposition bond layer of chromium is thus deposited on the target substrate. Such arc vapor deposition coating methods, utilizing an arc source to impart a positive charge on the vapor generated and a negative bias voltage to impart a negative charge on the substrate, are generally known in the art.

The steel substrate is formed from an non-oxidized steel substrate that has been cleaned and prepared to facilitate bonding with the preferred coating or bond layer or both. Prior to coating, the cleaning and the preparation of the steel substrate can be accomplished by conventional methods such as degreasing, grit blasting, etching, chemically assisted vibratory techniques, and the like. Such surface finishing techniques are well known to those skilled in the art. The preferred substrate surface finishing operations performed prior to the coating application include a grinding process to obtain a highly smooth surface, ultrasonic cleaning with an alkaline solution, and ion-etching of the substrate surface using argon. In addition, any heat treatment operations specified for the component are performed prior to coating applications.

In the preferred embodiment, the thin film coating process further comprises the step of forming a solid lubricant coating on the substrate by arc vapor deposition or sputtering process. As indicated above, the preferred coating is tungsten carbide containing carbon because such coatings result in improved boundary lubrication with a reduction in friction of the lubricated contact. Arc vapor deposition (AVD) is the preferred method of depositing the coatings, and in particular the chromium bond layer, if used, on the steel substrate because the AVD process is carried out at temperatures in the range of 150–250° C. or other temperatures which are below the tempering temperature of the selected grade steels. Likewise, the sputtering process is generally performed at temperatures that have little residual effect on the steel substrates. Thus, during the coating process, the hardness of the substrate is generally unaffected by the thin film coating procedure. The finished metal carbon material coating is preferably a uniform thickness (e.g. between about 0.5 micron and about 1.7 microns), smooth, adherent and free from visible defects. If used the preferred chromium bond layer is between about 0.05 and 0.5 microns thick.

INDUSTRIAL APPLICABILITY

The disclosed thin film coatings for fuel injector components, such as fuel injector needles, are particularly useful in highly loaded, marginally lubricated fuel injection system applications where component wear (both sliding and impact type) are typically encountered.

The component comprises a steel substrate and diamond like carbon primary coating (e.g. tungsten carbide containing carbon) deposited on the substrate. The primary thin film coating has a thickness generally no greater than about 2 microns and more preferably, a thickness of between about 0.5 microns and about 1.7 microns.

Optionally, a bond layer of chromium or other suitable metal is applied to improve the adhesion properties of the primary thin film coating to the substrate. Applying a bond layer between the steel substrate and the primary thin film coating is generally known in art. The bond layer has a thickness of less than 1.0 microns and more preferably of between about 0.1 microns and about 0.3 microns. The actual thickness and other physical property characteristics of the coating are preferably tailored to the application and environment in which the fuel injection system is to be used.

The use of the disclosed component coatings in such hostile fuel injection system applications provides advantages even after such coatings wear away. As may be expected, even the disclosed fuel injector component coatings wear over time and after continual use. However, as the coatings wear, the contacting surfaces of the underlying steel substrates exhibit corresponding wear patterns. Thus, even after the component coatings are no longer present, the contacting steel surfaces of the previously coated fuel injector components exhibit only marginal amounts, if any, wear.

In other words, even if the disclosed coatings wear away gradually, there is little or no wear problem between mating components because the mating surfaces of the needle valve member and nozzle are worn in such a way that the steel to steel interface is not highly frictional to cause wear. Thus, the disclosed coatings provide the added benefit of protecting the components from adhesive and abrasive wear much the same as a break in coating would protect contacting surfaces.

The illustrative example, as set forth below, shows the beneficial effect of the diamond like carbon coatings deposited by sputtering on a low alloy steel or tool grade substrate.

EXAMPLES

The following Examples will serve to further typify the nature of the invention but should not be construed as a limitation on the scope thereof.

Accelerated wear tests were performed on Caterpillar fuel injector components operating within a Caterpillar Fuel Injector. The fuel injector needles contained in the tested fuel injectors included at least one with a tungsten carbide containing carbon thin film coating on a low alloy steel substrate (52100 Steel), at least one with a tungsten carbide containing carbon thin film coating on a tool grade steel substrate (M2). The wear test was a combined needle check and corresponding tip wear test that measures the protrusion change in microns. Generally, the lower protrusion change represents improved wear characteristics. The test samples were compared to wear tests for two baseline Caterpillar fuel injectors having no coatings applied to the needle valve member. The two baseline samples included a needle valve member one made from a low alloy steel substrate (52100 Steel) and one made from a tool grade steel (M2). The Caterpillar Fuel Injectors were testing using direct injection of a Caterpillar fuel, 1E2820, which is a low lubricity diesel fuel. Eighteen 18 needles were utilized per test. The fuel injectors were tested for 125 hours and 250 hours before the wear comparisons were made.

Generally speaking, the tungsten carbide containing carbon coated fuel injector needles demonstrated very good wear resistance when pumping the low lubricity fuel as compared to the non-coated fuel injector needle of the same steel substrate. In addition, the needle check valve having a tool grade steel substrate and a tungsten carbide containing carbon thin film coating performed better than expected at the 250 hour test intervals. Comparative test results are given in the following table.

| Test Sample (Combined Wear Test) | Check Protrusion @ 125 Hours | Check Protrusion @ 250 Hours |
|---|---|---|
| Baseline Non-Coated Low Alloy Steel Injector Needle | 51 Microns | 96 Microns |
| Baseline Non-Coated Tool Grade Steel Injector Needle | 67 Microns | 47 Microns |
| Low Alloy Steel Substrate, Tungsten Carbide/Carbon Coated Injector Tungsten | 18.5 Microns<br>14 Microns | |
| Tool Grade Steel Substrate, Tungsten Carbide/Carbon Coated Injector Needle | 21.5 Microns<br>21 Microns | 24 Microns |

From the foregoing, it should be appreciated that the present invention thus provides a coating or surface treatment for fuel injection system components such as fuel injector needles. While the invention herein disclosed has been described by means of specific embodiments and processes associated therewith, numerous variations can be made thereto by those skilled in the art without departing from the scope of the invention as set forth in the claims or sacrificing all its material advantages.

What is claimed is:

1. A fuel injector comprising:

at least one fuel injector component including:

a steel substrate; and a coating covering at least a portion of the steel substrate;

wherein the coating includes a bond layer disposed over the steel substrate and a primary layer disposed over the bond layer, and wherein the primary layer of the coating has a thickness of no greater than about 2 microns.

2. The fuel injector of claim 1, wherein the primary layer includes tungsten-carbide containing carbon.

3. The fuel injector of claim 1, wherein the primary layer includes tungsten carbide.

4. The fuel injector of claim 1, wherein the at least one fuel injector component includes a needle valve member.

5. The fuel injector of claim 1, wherein the primary layer of the coating has a thickness of between about 0.5 microns and about 1.7 microns.

6. The fuel injector of claim 1, wherein the coating covers substantially all of the steel substrate.

7. The fuel injector of claim 1, wherein the coating covers only a portion of the steel substrate.

8. The fuel injector of claim 1, wherein the bond layer includes chromium.

9. The fuel injector of claim 1, wherein the coating has a hardness of greater than 1000 $Kg/mm^2$ as measured using a Hardness Knoop HDNS 50 gram load.

10. The fuel injector of claim 1, wherein the steel substrate is a tool grade steel substrate.

11. A fuel injector comprising:

at least one fuel injector component including:

a steel substrate; and a coating covering at least a portion of the steel substrate;

wherein the coating includes a bond layer disposed over the steel substrate and a primary layer disposed over the bond layer, and wherein the primary layer includes at least one of titanium containing diamond like carbon, chromium containing diamond like carbon, and tungsten containing diamond like carbon.

12. The fuel injector of claim 11, wherein the primary layer includes tungsten containing diamond like carbon.

13. A fuel injector comprising:

at least one fuel injector component including:

a steel substrate; and a coating covering at least a portion of the steel substrate;

wherein the coating includes a bond layer disposed over the steel substrate and a primary layer disposed over the bond layer, and wherein the bond layer has a thickness of no greater than about 1.0 micron.

14. The fuel injector of claim 13, wherein the bond layer has a thickness between about 0.05 microns and about 0.5 microns.

15. The fuel injector of claim 13, wherein the bond layer has a thickness between about 0.1 microns and about 0.3 microns.

16. A fuel injector comprising:

at least one fuel injector component including:

a steel substrate; and a coating covering at least a portion of the steel substrate;

wherein the coating includes a bond layer disposed over the steel substrate and a primary layer disposed over the bond layer, and wherein the coating has a coefficient of friction of less than about 0.5.

17. The fuel injector of claim 16, wherein the coating has a coefficient of friction of less than about 0.2.

18. A fuel injector comprising:

at least one fuel injector component including:

a steel substrate; and a coating covering at least a portion of the steel substrate;

wherein the coating includes a bond layer disposed over the steel substrate and a primary layer disposed over the bond layer, and wherein the coating has a boundary lubricity value greater than the steel substrate as measured using an ISO 12156 version 1.3 HFRR.

19. A fuel injector comprising:

at least one fuel injector component including a tool grade steel substrate; and a coating disposed over at least a portion of the tool grade steel substrate, wherein the coating has a hardness value of at least 1000 $Kg/mm^2$ as measured using a Hardness Knoop HDNS 50 gram load.

20. The fuel injector of claim 19, wherein the at least one fuel injector component includes a needle valve member.

21. The fuel injector of claim 19, wherein the coating includes a bond layer disposed over the substrate and a primary layer disposed over the bond layer.

22. The fuel injector of claim 21, wherein the bond layer includes chromium.

23. The fuel injector of claim 21, wherein the primary layer includes tungsten carbide.

24. The fuel injector of claim 21, wherein the primary layer includes tungsten containing diamond like carbon.

25. The fuel injector of claim 21, wherein the bond layer has a thickness of no greater than about 1.0 micron.

26. The fuel injector of claim 21, wherein the bond layer has a thickness between about 0.05 microns and about 0.5 microns.

27. The fuel injector of claim 21, wherein the primary layer has a thickness of between about 0.5 microns and about 1.7 microns.

28. The fuel injector of claim 21, wherein the primary layer has a coefficient of friction of less than about 0.5.

29. The fuel injector of claim 21, wherein the primary layer has a coefficient of friction of less than about 0.2.

* * * * *